US005352135A

United States Patent [19]

Lenoir

[11] Patent Number: 5,352,135

[45] Date of Patent: Oct. 4, 1994

[54] POLYGONAL CONNECTOR, IN PARTICULAR A RECTANGULAR CONNECTOR INCORPORATING A CENTRAL INSULATOR

[75] Inventor: Michel Lenoir, Montfort le Gesnois, France

[73] Assignee: Framatome Connectors International, Paris La Defense, France

[21] Appl. No.: 29,242

[22] Filed: Mar. 10, 1993

[30] Foreign Application Priority Data

Mar. 10, 1992 [FR] France ..... 92 02827

[51] Int. Cl.[5] ..... H01R 13/658

[52] U.S. Cl. ..... 439/607; 439/903

[58] Field of Search ..... 439/607-610, 439/903, 345, 347

[56] References Cited

U.S. PATENT DOCUMENTS

| | | | |
|---|---|---|---|
| 4,053,199 | 10/1977 | Hollyday et al. | 439/607 |
| 4,119,664 | 5/1985 | Tillotson | 439/607 |
| 4,941,776 | 4/1984 | Anhalt | 339/91 R |
| 4,659,162 | 4/1987 | Cartesse | 439/903 |
| 4,941,831 | 7/1990 | Tengler et al. | 439/607 |
| 5,037,331 | 8/1991 | Goodman et al. | 439/607 |
| 5,145,411 | 9/1992 | Pastal et al. | 439/903 |

FOREIGN PATENT DOCUMENTS

| | | |
|---|---|---|
| 0422766 | 4/1991 | European Pat. Off. . |
| 8903639 | 6/1989 | Fed. Rep. of Germany . |
| 8902170 | 3/1989 | PCT Int'l Appl. . |

*Primary Examiner*—Larry I. Schwartz
*Assistant Examiner*—Hien D. Vu
*Attorney, Agent, or Firm*—Wegner, Cantor, Mueller & Player

[57] ABSTRACT

The invention concerns a rectangular connector comprising a casing (2) housing a central insulator (1) incorporating electric contact elements (16). One bar element (41) is positioned at each longitudinal end of central insulator (1), and a lug (50) is positioned on one transverse inner face (22) of the casing (2). The bar elements comprise a central part (41), each of whose ends is extended by an elastic central part (42, 43) so as to improve flexibility of the arm (41).

17 Claims, 4 Drawing Sheets

POLYGONAL CONNECTOR, IN PARTICULAR A RECTANGULAR CONNECTOR INCORPORATING A CENTRAL INSULATOR

BACKGROUND AND SUMMARY OF THE INVENTION

The present invention concerns a polygonal connector, in particular a rectangular connector incorporating a box in which a central insulator comprising electrical contact elements is positioned.

An electric polygonal connector, e.g., a rectangular connector adhering to standard SCSI-2, normally comprises a rigid case, in particular a metal body, which provides the stiffness of the connector and in which are housed both the central insulator comprising several rows of parallel contact elements and, in connectors incorporating female contacts, metal sheathing which surrounds the portion of this insulator in which the matching male contact connector is fitted.

The central insulator can be attached to the metal body forming the case using wings which extend beyond the insulator on the rear of the connector and fasten onto the metal body. This attachment system has the disadvantage of not being usable for connectors comprising miniature straight contacts, since too much space is required. Moreover, this extension system belonging to the connector is vulnerable to the handling operations necessary, in particular, during the steps in the manufacturing process.

Conventional practice also provides for fastening, especially during the manufacturing process, the metal body onto the central insulator solely by spot crimping, once the contact-carrier insulator has been inserted in the metal body. This technique entails the disadvantage of requiring two distinct operations, i.e., the insertion of the insulator, then the crimping of the metal body in order to fasten it to the insulator. Furthermore, it proves especially well-suited for straight contact connectors.

The present invention concerns a fastening system which, on the one hand, can be used equally well for connectors incorporating male or female contacts, whether these contacts are straight or bent, and, on the other hand, have substantially-reduced dimensions while providing for precise mechanical positioning of the contact-carrier insulator in relation to the connector case.

The invention thus concerns a polygonal connector incorporating a case in which a central insulator comprising electric contact elements is positioned, this positioning being produced by the joint functioning of at least one bar and at least one lug, the central insulator reaching a stopped position in relation to the case, the connector being characterized by the fact that the principal axis of this bar extends alongside a portion of a polygonal outline shared by the case and the central insulator.

This fastening system makes possible, moreover, the manufacture of an identical insulator for both straight and bent contact connectors.

The bar element is advantageously positioned at one longitudinal end of the central insulator, and the lug is advantageously placed on an interior transverse face of the case.

To ensure precise positioning and optimal stiffness of the assembly, the connector according to the invention comprises two bar elements, each of which is positioned at one longitudinal end of the insulator, and each of two lugs is placed on one interior transverse face of the case.

According to a preferred embodiment, the lug is adjacent a median part of the corresponding bar element. This arrangement allows optimal use of the elasticity of the bar when it passes onto the lug.

The bar element may slope in relation to the direction of insertion of the central insulator, so as to facilitate the sliding motion of the bar along the corresponding lug.

The median part of the bar is advantageously located outside of an area in which the central insulator is stopped within the casing, the lug being extended rearward by a groove.

According to a preferred embodiment, the bar element comprises a central part, each of whose ends is extended by an elastic arm substantially perpendicular to the central part. In this way, a higher degree of elasticity is obtained during insertion of the central insulator, while maintaining its precise position within the case.

The bar element advantageously forms an integral part of the central insulator.

A sheathing cover may be housed between the central insulator and the casing. This sheathing cover can be attached to the central insulator because of the joint functioning of two longitudinal edges, one upper and one lower, and of lugs positioned on two longitudinal shoulders, one upper and one lower, belonging to the central insulator. These lugs make it possible to preliminarily position the sheathing cover on the central insulator, this sheathing cover then being locked in position between the central insulator and the casing.

Finally, the casing may comprise notches designed to work in conjunction with locking arms belonging to a connection element which functions electrically in cooperation with this connector.

Other features and advantages of the invention will emerge from a reading of the following description provided as a non-limiting example and with respect to the drawings, in which:

BRIEF DESCRIPTION OF THE DRAWINGS

FIG. 1 is an exploded view of the rear face of a connector according to the invention.

DETAILED DESCRIPTION OF THE INVENTION

Figures 1A, 1B, 1C:
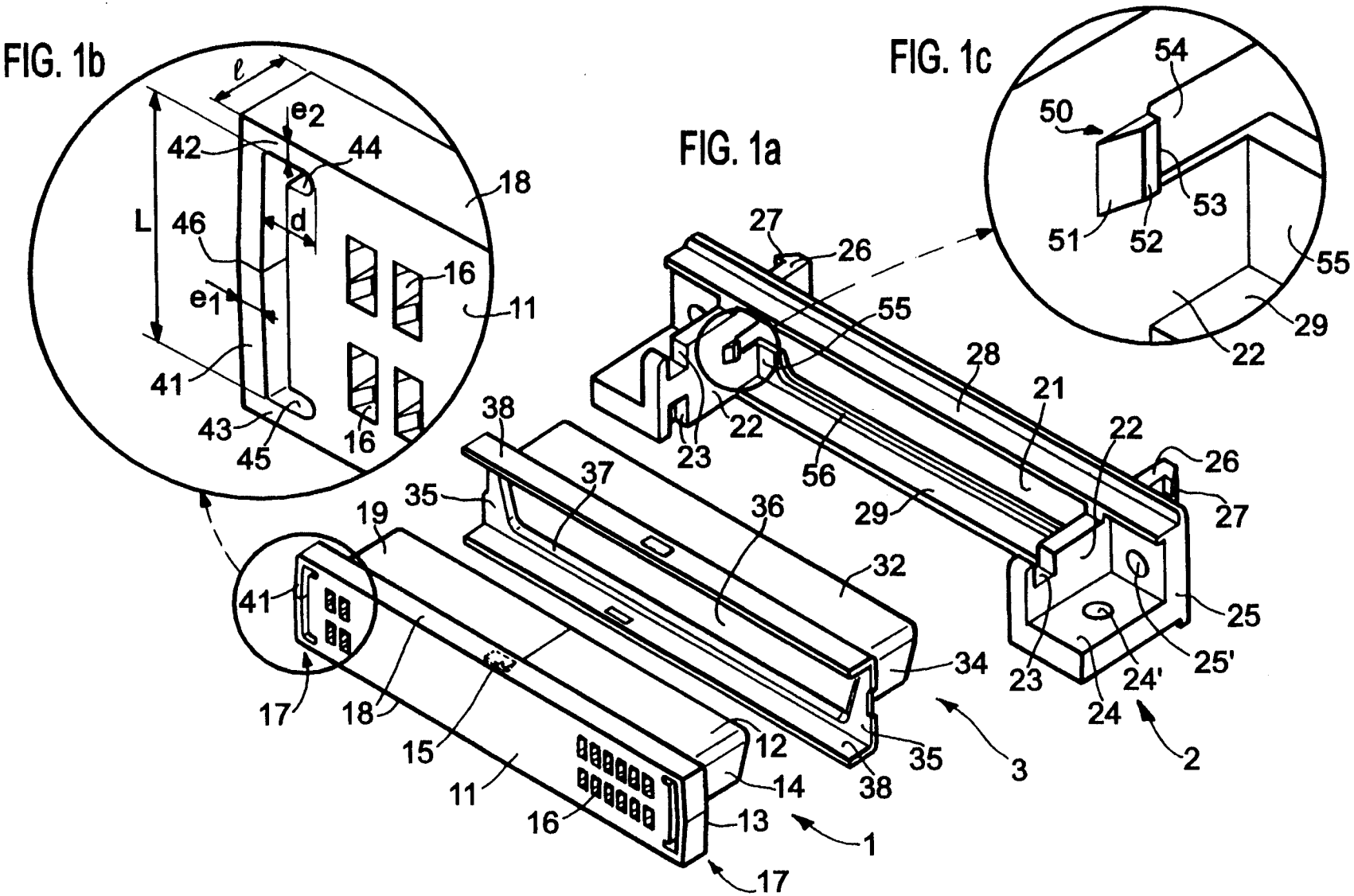
FIGS. 1*b* and 1*c* detail views, respectively, of a bar element and of the corresponding lug of FIG. 1*a*.
Figure 2A:
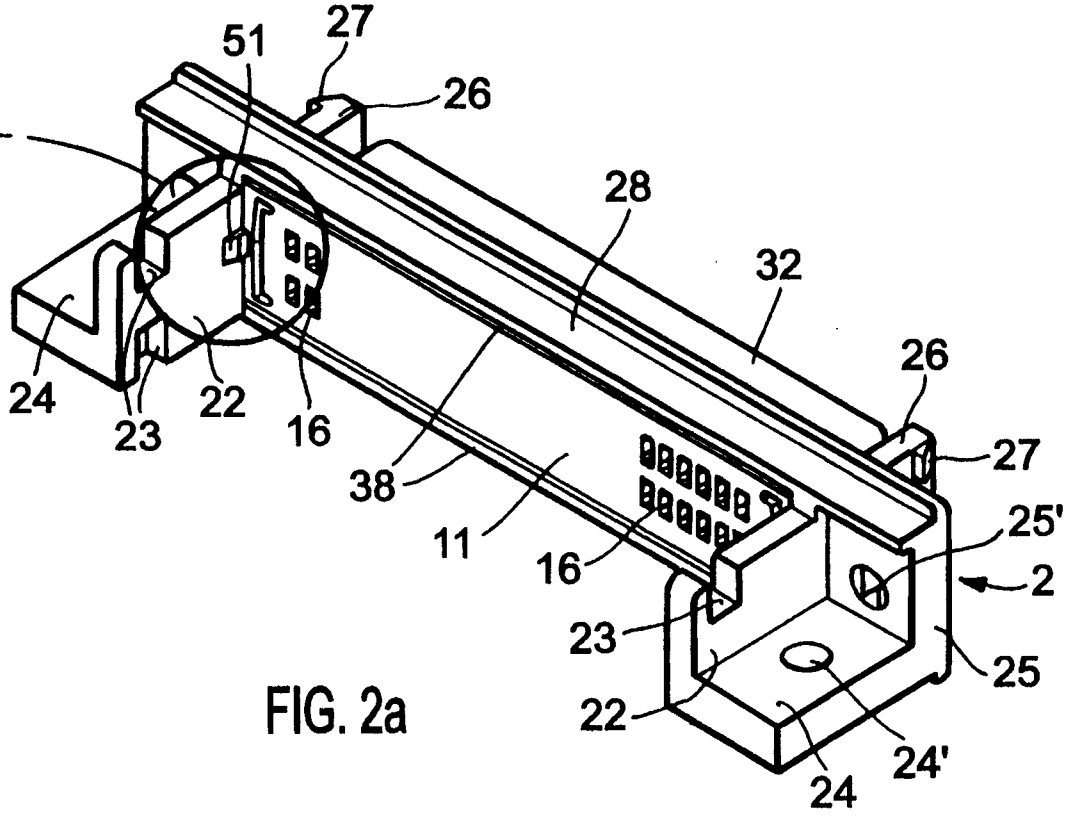
FIG. 2*a* a rear view of a connector according to the invention assembly.
Figure 2B:
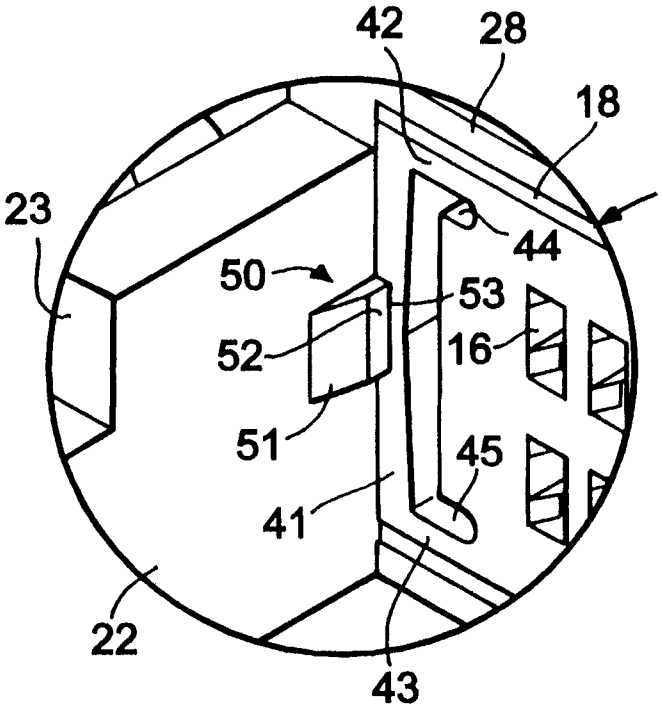
FIG. 2*b* is a detail view of FIG. 2*a*, showing the joint functioning of the bar element and of a corresponding lug.
Figure 3A:
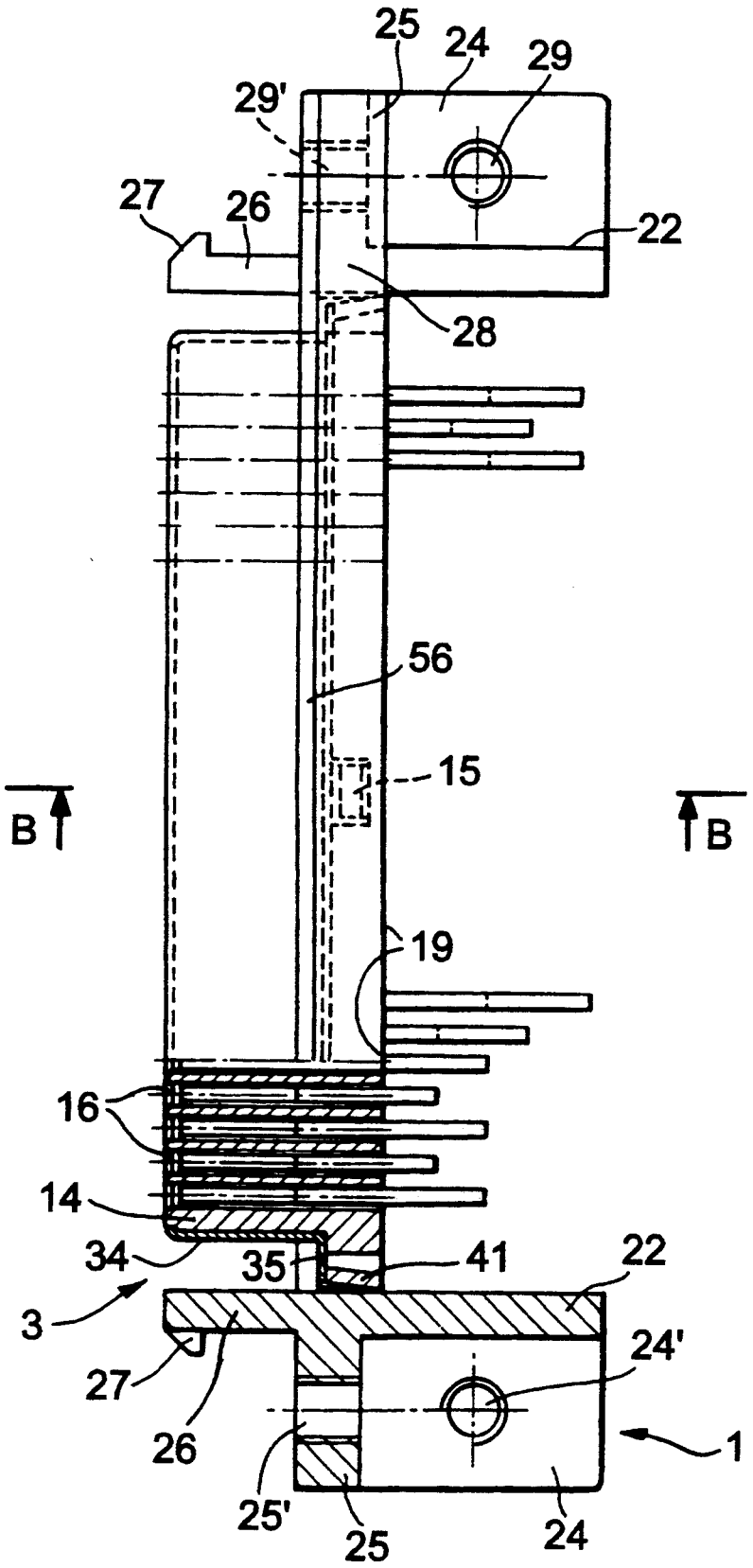
FIG. 3*a* is a top view with partial cross-section.
Figure 3B:
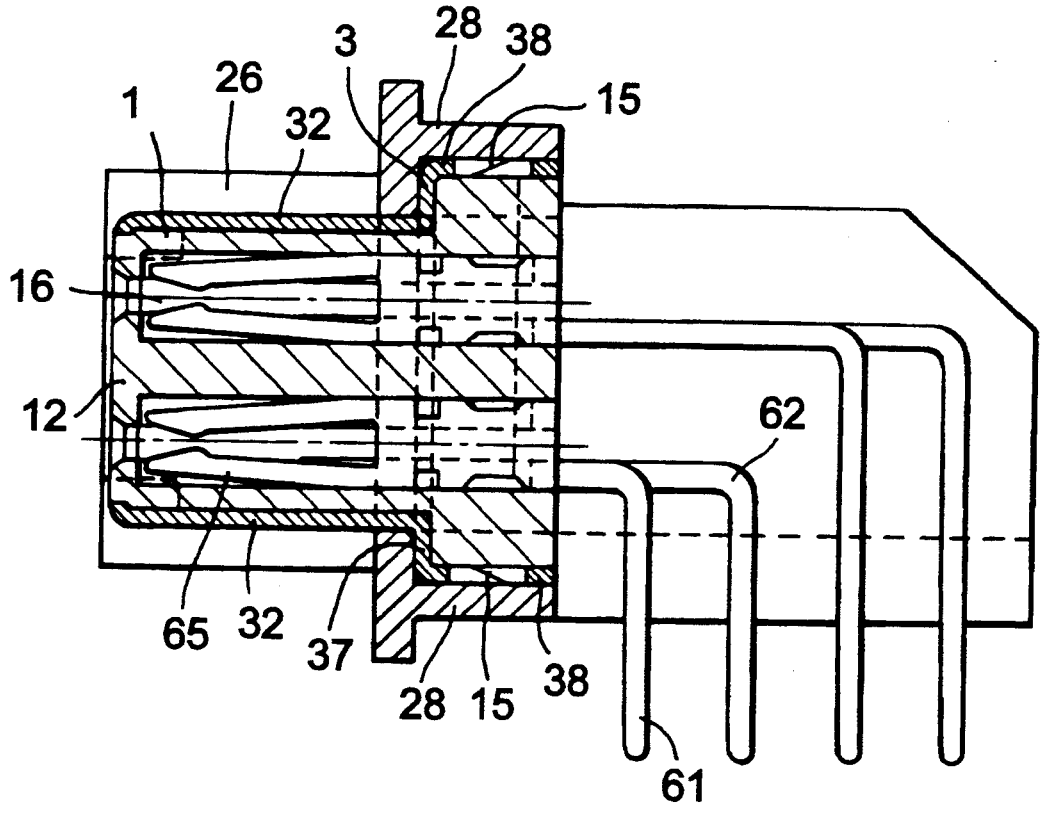
FIG. 3*b* is a cross-section view, along B—B in FIG. 3*a*, of a series of bent connections.

In FIGS. 1*a*–1*c*, a rectangular-type connector incorporates a central insulator 1 having a rear face 11, in which emerge, for example, female connection elements (not shown in these Figures; see FIG. 3*b*, reference 65). The rear face 11 comprises an upper and a lower edge 18 and lateral edges 17. The rear face 11 is extended by a front face 12 whose contour is inscribed inside that of the rear face 11 and which has an upper and a lower longitudinal edge 19 substantially parallel to the upper and lower edges 18, as well as lateral edges 14 not perpendicular to the edges 19.

The longitudinal ends of the central insulator 1 incorporate a bar element 41 delimited by its thickness $e_1$ parallel to the longitudinal direction in which edges 18 of the rear face 11 extend, by its length L running perpendicularly to this direction within the plane of the rear face 11, and by its width 1 extending perpendicularly to both of the aforementioned directions. The bar 41 may advantageously be extended by two elastic arms 42 and 43, which are perpendicular to it and have a thickness $e_2$ and a length d delimited by two grooves 44 and 45.

The casing 2 is preferably made of a conductive material, e.g., a zinc-based alloy known by its tradename "ZAMAC." The metal body forming the casing 2 has a rear face incorporating two longitudinal edges, one upper and one lower, 28 and 29 respectively, and two trihedrons composed of orthogonal elements referenced as 22, 24, and 25 and making possible, by means of holes 24' and 25', in particular, the attachment of the casing 2 to a support such as a frame or a printed circuit.

Each trihedron comprises, first, a vertical element 25 which extends the upper edge 28 in the direction of the lower edge 29, and second, an element 22, also vertical but perpendicular to the upper edge 28, which connects with the element 25. The lower edge 29 extends between the two elements 22. Finally, the trihedron is completed by a horizontal element 24. Attachment holes 24' and 25' are arranged within the trihedrons 24 and 25.

Profiles 56, one upper and one lower, which extend vertically beginning at the front face of the shoulders or edges 28 and 29, make it possible to hold the central insulator 1 in the stopped position by means of the front plane 13 of the rear face 11, the front face 12 passing through an opening 21 delimited by the profiles 56 and their extensions 55 located at the two ends of each profile 56.

The interior face 22 of the trihedral element 22 has, at substantially the mid-point of its height, a lug 50 incorporating, in succession, an inclined profile 51, and area 52 parallel to the element 22, and an area forming a stop 53 substantially perpendicular to the plane of the element 22. Finally, each of the elements 22 can be extended toward the front by a locking element comprising an arm and a lug 27.

Figure 3C:
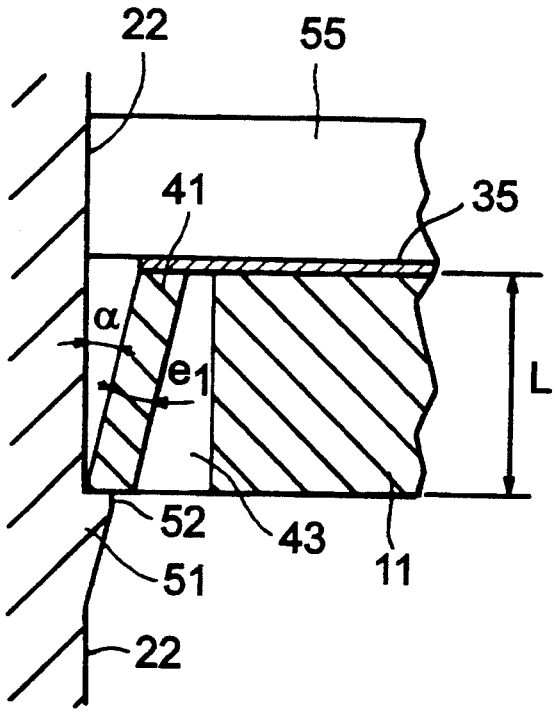
FIG. 3*c* is an enlarged detail view of FIG. 3*a* showing the area surrounding the bar element.

The sheathing cover 3 comprises a rear part having longitudinal edges 38 arranged so as to engage with pre-positioning lugs 15 positioned in the middle of the longitudinal edges 18 of the central insulator 1. The longitudinal edges 38 are connected using vertical portions, 35, the assembly delimiting, in conjunction with the upper and lower shoulders 37, an opening 36 which receives inserted front face 12 until it reaches the stopped position on the front plane 13 of the rear face 11. The central insulator 1 can be mounted on the casing 2 with or without interpositioning of the sheathing cover 3. At the time of insertion, the median part 46 of the bar 41 is pushed gradually backward by the profile 51 of the lug 50, after which the bar 41 regains its initial position so as to lock the central insulator in position in the casing 2. It will be noted (see FIG. 3*c*) that this insertion operation can be facilitated by inclining the bar 41 by an angle $\alpha$ in relation to the interior face of the element 22 belonging to the casing 2.

The bar 41 can, therefore, undergo two types of deformation in succession during insertion. The lug 50 deforms the bar in a direction perpendicular to the interior face of the element 22, and this deformation is absorbed by the central part 41 and by the arms 42 and 43. This allows reduction of stresses and makes possible good elasticity, despite its reduced dimensions. This function is optimally performed when the lug 50 is positioned in immediate proximity to the median part 46 of the bar 41. The length L, the width 1, and the thickness e of the bar 41 allow adjustment of its flexibility. The flection of the elastic arms 42 and 43, whose elasticity is determined by their length d, their width 1, and their thickness $e_2$ allows a swinging motion of the bar perpendicular to its longitudinal planar axis.

In an arrangement complementary to the action of the bar element 41, the central insulator 1 can comprise a crimping device (not shown) positioned on at least one longitudinal edge 18.

FIGS. 3*a* and 3*b* show a complete connection assembly utilizing a male connector of the bent contact type housing the male elements 61, bent at 62.

I claim:

1. A polygonal connector comprising:

a casing;

a central insulator having front and rear parts and incorporating electrical contact elements disposed in said front part, said front part protruding from said rear part along an insertion axis and being insertable within said casing to a limited depth and said front part having an external polygonal contour which is smaller than an external contour of said rear part;

returning means for positioning said central insulator within and in locking engagement with at least one side of said casing said retaining means comprising at least one lug of said casing engageable and lockable with a corresponding bar element of said central insulator, said bar element having a central part spaced from said rear part of said central insulator in a direction laterally of said insertion axis and elastic arms connecting respective ends of said central part to said rear part so as to effect said locking engagement of said lug with said central part.

2. Connector according to claim 1, wherein said connector is rectangular.

3. Connector according to claim 2, wherein said connector comprises two said bar elements, each positioned at an opposite longitudinal end of said central insulator and two said lugs, each of which is positioned on an interior face of said casing.

4. Connector according to claim 1, wherein said central part of said bar element is inclined in relation to said insertion axis so as to facilitate sliding motion of the bar element along the corresponding lug.

5. Connector according to claim 1, wherein said lug is situated on said casing for engagement with only a median part of the corresponding bar element.

6. Connector according to claim 1, wherein said bar element is formed as an integral part of said central insulator.

7. Connector according to claim 1, and further comprising: a sheathing cover housed between said central insulator and said casing.

8. Connector according to claim 7, wherein said sheathing cover comprises two longitudinal edges and said insulator rear part further comprises corresponding prepositioning lugs engageable with said upper and lower edges of said sheathing cover.

9. Connector according to claim 1, wherein said casing is made of a conductive material.

10. Connector according to claim 3, wherein said central part of said bar element is inclined in relation to said insertion axis so as to facilitate sliding motion of the bar element along the corresponding lug.

11. Connector according to claim 3, wherein said lug is situated on said casing for engagement with only a median part of the corresponding bar element.

12. Connector according to claim 3, wherein said bar element is formed as an integral part of said central insulator.

13. Connector according to claim 3, and further comprising: a sheathing cover housed between said central insulator and said casing.

14. Connector according to claim 3, wherein said casing is made of a conductive material.

15. Connector according to claim 6, and further comprising: a sheathing cover interposed between said central insulator and said casing.

16. A connector as in claim 1, and further comprising: said rear part providing said insertable depth limit for said front part.

17. A connector as in claim 1, and further comprising: said bar element being generally coplanar with said rear part.

* * * * *